US009263223B2

(12) United States Patent
Duerr et al.

(10) Patent No.: US 9,263,223 B2
(45) Date of Patent: Feb. 16, 2016

(54) ION GENERATION IN MASS SPECTROMETERS BY CLUSTER BOMBARDMENT

(71) Applicant: Bruker Daltonik GmbH, Bremen (DE)

(72) Inventors: Michael Duerr, Giessen (DE); Christoph Gebhardt, Bremen (DE)

( * ) Notice: Subject to any disclaimer, the term of this patent is extended or adjusted under 35 U.S.C. 154(b) by 302 days.

(21) Appl. No.: 13/870,166

(22) Filed: Apr. 25, 2013

(65) Prior Publication Data

US 2013/0285552 A1 Oct. 31, 2013

(30) Foreign Application Priority Data

Apr. 25, 2012 (DE) ..... 10 2012 008 259

(51) Int. Cl.

| | |
|---|---|
| ***H01J 7/24*** | (2006.01) |
| ***H05B 31/26*** | (2006.01) |
| ***H01J 27/02*** | (2006.01) |
| ***H01J 49/04*** | (2006.01) |
| ***H01J 49/14*** | (2006.01) |

(52) U.S. Cl.
CPC ..... *H01J 27/026* (2013.01); *H01J 49/0481* (2013.01); *H01J 49/142* (2013.01)

(58) Field of Classification Search
USPC ..... 315/111.01–111.91; 250/281–300
See application file for complete search history.

(56) References Cited

U.S. PATENT DOCUMENTS

| | | | | |
|---|---|---|---|---|
| 6,831,272 | B2 * | 12/2004 | Mack et al. | 250/287 |
| 7,247,845 | B1 | 7/2007 | Gebhardt et al. | |
| 7,629,576 | B2 | 12/2009 | Schultz et al. | |
| 8,507,850 | B2 * | 8/2013 | Whitehouse et al. | 250/288 |
| 2004/0238754 | A1 | 12/2004 | Baranov et al. | |
| 2007/0278397 | A1 * | 12/2007 | Bateman et al. | 250/286 |
| 2008/0185511 | A1 * | 8/2008 | Senko | 250/283 |
| 2008/0203286 | A1 | 8/2008 | Loboda | |
| 2009/0218486 | A1 * | 9/2009 | Whitehouse et al. | 250/288 |

* cited by examiner

*Primary Examiner* — Brandon S Cole
(74) *Attorney, Agent, or Firm* — Benoit & Cote, Inc.

(57) ABSTRACT

The invention relates to devices and methods in mass spectrometers for the generation of ions of heavy molecules, especially biomolecules, by bombarding them with uncharged clusters of molecules. The analyte ions which are generated or released by cluster bombardment of analyte substances on the surface of sample support plates show a broad distribution of their kinetic energies, which prevents good ion-optical focusing. In the invention, the kinetic energies are homogenized in a higher-density collision gas. The collision gas is preferably located in an RF ion guide, more preferably an RF ion funnel, which can transfer the ions to the mass analyzer. The collision gas may be introduced with temporal pulsing, coordinated or synchronized with the pulsed supersonic gas jet. The collision gas may be pumped off again before the next supersonic gas pulse. In an advantageous embodiment, the collision gas can originate from the supersonic gas jet itself.

16 Claims, 6 Drawing Sheets

ION GENERATION IN MASS SPECTROMETERS BY CLUSTER BOMBARDMENT

BACKGROUND OF THE INVENTION

1. Field of the Invention

This invention relates to devices and methods for the generation of ions of heavy molecules, especially biomolecules, in mass spectrometers by bombarding them with uncharged clusters of molecules.

2. Description of the Related Art

In the document EP 1 200 984 B1 (C. Gebhardt and H. Schroder, 1999; corresponding to U.S. Pat. No. 7,247,845 B1), an ionization of large analyte molecules located on the surface of a solid sample support by bombardment with uncharged clusters of molecules is described. The clusters are generated from polar molecules, such as $H_2O$ or $SO_2$, within a supersonic jet. The document also discusses the literature in detail, which predominantly investigates the ionization of cluster fragments which are generated by the impact of electrically charged and electrically accelerated clusters on surfaces, but not the ionization of large analyte molecules on sample supports by uncharged clusters.

The term "cluster" usually refers to ensembles of atoms or molecules which are relatively weakly bound by physical forces such as van-der-Waals forces or hydrogen bridge bonds, for example, and whose density is comparable with that of liquids or solids, but which outwardly have the character of a gas phase particle. The cluster size can be adjusted to suit the application and can range from a few tens to many thousands or even hundred thousands of molecules. Correspondingly, the clusters have diameters which range from one to a hundred nanometers.

The clusters can be generated from gaseous cluster substance molecules in many different ways. In a particularly simple method, which was first described in the document referenced above, the cluster substance molecules are added to a carrier gas, such as helium, at concentrations of one to three percent, sometimes up to five percent. The carrier gas is allowed to expand through a suitable nozzle connected to a switching valve in short pulses of 50 to 200 microseconds duration from a pressure of $1\times10^6$ to $2\times10^6$ pascal (10-20 bar) into a good vacuum of better than $10^{-3}$ pascal, such as $10^{-1}$ pascal or even less. The adiabatic expansion produces a cold supersonic gas jet, and the condensation of the cluster substance molecules into uncharged clusters takes place within the nozzle and in a short segment behind it. Quantity and size of the clusters are determined by the starting pressure, the starting temperature, the concentration of the cluster substance molecules and by the diameter and shape of the switching valve nozzle. They also depend on the type of carrier gas used. Clusters generated in this way have a broad size distribution. Since the cluster substance molecules introduce the binding energy for each molecule into the cluster as thermal energy during condensation, and since cooling in the light carrier gas is very slow, such a cluster resembles a liquid or solid particle that is always in equilibrium between vaporization and condensation of cluster substance molecules, just below the boiling point at the corresponding pressure within the supersonic jet. This makes the cluster extremely unstable. When the carrier gas is hydrogen, the clusters formed are smaller than those formed in helium because the lower mass of hydrogen means even less cooling of the cluster is available for cluster growth in hydrogen than in helium.

In this generation method, the clusters are also simultaneously accelerated to the velocity of the supersonic gas jet and can be fired onto the sample support plate with this velocity. This velocity can be controlled. Depending on the type of gas and the starting temperature, such a supersonic gas jet can reach velocities of the order of 1,500 to 2,000 meters per second for (pure) helium, and even 2,500 to 3,500 meters per second for (pure) hydrogen. The addition of the heavier cluster substance molecules reduces these velocities accordingly by some 10 to about 30 percent for the gas molecules as well as for the clusters. These velocities are still so high that the kinetic energy $E_{kin}$ per cluster substance molecule is comparable to the average binding energy $E_{bind}$ of the molecules in the cluster group. Depending on the ratio of $E_{kin}$ and $E_{bind}$, the cluster can therefore be more or less completely decomposed into the individual cluster substance molecules when impacting onto the surface of a solid body, i.e., the cluster is transformed into a hot gas with high pressure.

The cluster substance molecules which have been investigated most are $SO_2$ and $H_2O$, but the substance $HNO_3$ (nitric acid), which dissociates easily, has also been applied.

The bombardment of the sample support plate with clusters requires a good vacuum. In an environment of $10^{-3}$ pascal, the unstable clusters fly to the sample support plate without being destroyed. However, the pressure increases rapidly due to the inflowing gas of the supersonic gas jet and, depending on the pumping capacity and quantity of inflowing gas, reaches pressures above 10 pascal in 10 to 1,000 microseconds. At these pressures, the clusters already noticeably decompose. At pressures of 100 pascal, for example, the clusters are completely decomposed after a short distance of a few centimeters. The path of the supersonic gas jet from the nozzle to the sample support plate must therefore be maintained at a pressure below ten pascal, preferably below one pascal, at least for the desired duration of the bombardment. Since the pumping capacity is variable only to a small extent, the pressure increase essentially depends on the diameter of the nozzle, which determines the inflowing quantity of gas. The pressure of around $10^{-3}$ pascal is to be restored by the time of the next supersonic gas pulse; this limits the supersonic pulses to a rate of around 10 to 20 pulses per second; sometimes, however, also up to 100 pulses per second.

As stated above, the clusters have diameters of far less than one micrometer, for example, on a nanometer scale. At a velocity of 1,000 meters per second, the impact takes less than one picosecond from the first contact until standstill. The kinetic energy of the cluster is converted into thermal energy. Even before impact, the clusters already form unstable particles just below boiling point. So when an impact occurs, a compressed gas cloud of free cluster substance molecules with the density of a liquid, and therefore a very high pressure (possibly one thousand bar or higher) and a very high kinetic temperature (possibly one thousand kelvin or higher), is formed due to an immediate phase transition from solid or liquid to gaseous. The question is still unanswered as to whether a large proportion of the cluster substance molecules is ionized, like in a plasma, because the time to assume an equilibrium ionization according to the Saha-Eggert equation may not be available. Fast chemical reactions can, however, occur in the expanding gas cloud, such as a reaction of $SO_2$ and water, which was adsorbed on the sample support plate, to form $H_2SO_3$, so proton donors are available in the gas cloud. In the short time of less than one picosecond, the cluster is flattened, and the crushing of the molecules on the sample support plate entrains water and analyte molecules and embeds them into the gas cloud. Large biochemical analyte molecules are often already present in ionized form on the sample support and surrounded by water solvate sheaths, so they are transferred into the gas cloud as ions. As the analyte molecules and analyte ions are embedded into the hot gas of the gas cloud, their internal energy is hardly increased because the process of energy absorption into the inside of the molecule takes considerably longer.

The hot gas cloud now expands adiabatically into the surrounding vacuum, thus reducing the kinetic temperature very quickly, and supersonic speeds are again reached in the front of the gas cloud. During this adiabatic expansion, cluster substance molecules can also condense again as micro-clusters. On the picosecond scale the adiabatic expansion proceeds very slowly, however. During the first picoseconds the inertia of the molecules means that the gas cloud expands by only a few nanometers; only after a million picoseconds, i.e. a microsecond, has the gas cloud expanded to a diameter of around half a millimeter. Velocities of the order of 500 to 1,000 meters per second are attained here in the front of the gas cloud; in the back portion of the gas cloud, near the sample support plate, the velocities are much lower. The local velocities of the cluster substance molecules in the gas cloud are approximately proportional to their distance from the sample support plate.

The adsorbed analyte molecules and analyte ions, which are quite unavoidably taken up in this process, are found in the cloud near to the sample support plate and are therefore accelerated to lower velocities in the range from close to zero up to 100 meters per second. Nevertheless, since their mass is often large, they achieve kinetic energies which have a very broad distribution in the range from close to zero right up to 100 electronvolts and more.

Water molecules adsorbed on the sample support or on the analyte molecules combine with different suitable cluster substance molecules to form proton donors, which are available for proton transfers. When $SO_2$ is used as the cluster substance, for example, $H_2SO_3$ is formed with the water molecules, dissociated to a high degree into free protons and $SO_3^{2-}$. Even if not dissociated, $H^2SO^3$ easily releases protons if a substance with proton affinity is nearby. If the uncharged analyte molecules have surface regions which have a proton affinity, they can accept free protons or protons by proton transfer if they are in the close vicinity, and thus form further analyte ions. The analyte molecules which were already charged when stationary, or are first ionized in the gas, can now be extracted by electric fields and fed to an application. However, it is highly disadvantageous here that their kinetic energies have a very broad distribution, since this makes good ion-optical focusing impossible.

The document EP 1 200 984 B1 referenced above already disclosed that an ionization of analyte molecules by cluster bombardment could be used in mass spectrometric ion sources, for example in ion sources for time-of-flight mass spectrometers, but the document does not provide details of the technique to be used to capture the analyte ions with a high yield. The generation and capture of the analyte ions should produce a high yield in such ion sources, but even the capture of the analyte ions presents a technical problem.

In view of the above, there is a need for devices and methods to produce analyte ions from analyte molecules on sample support plates by cluster bombardment with a high yield and to capture them in such a way that they can be introduced into a mass spectrometer with a high efficiency.

SUMMARY OF THE INVENTION

It is an important point of the invention that analyte ions generated with high spread of their kinetic energies by cluster bombardment of analyte substances on the surface of a sample support, are decelerated in a pulsed higher-density collision gas. The analyte ions are accelerated to a broad energy distribution by the tiny expanding gas clouds of the impacting clusters. Their kinetic energy is homogenized by a multitude of collisions with the collision gas molecules. The collision gas is located in a deceleration region through which the analyte ions have to fly. But since the collision gas can only be kept in the largely open deceleration region for a short period of time, and its diffusion into other regions destroys the clusters in the supersonic jet, it may be introduced into the deceleration region in short pulses, coordinated and/or synchronized with the pulsed supersonic gas jet, whose clusters generate the analyte ions. The collision gas expands quickly from the deceleration region into the surroundings, thereby decomposing the clusters in the supersonic gas jet due to the pressure increase, and thus ending the cluster ionization process, if the supersonic gas jet has not already been terminated by closing the switching valve of the nozzle. The collision gas may be pumped off again before the next supersonic gas pulse is started.

The deceleration region can be located in an RF ion guide. It is particularly favorable if the interior of an RF ion funnel is used as the deceleration region. The decelerated analyte ions can then be concentrated and guided by the electric field within the RF ion funnel in the usual way to a small exit aperture, through which they enter into the next pumping stage of the mass spectrometer (or also directly into an ion trap). The deceleration in the RF ion funnel and the forced oscillation in the damping gas also advantageously cause a complete removal of cluster substance molecules, which may still be attached in the form of a solvate sheath.

The deceleration gas pulses may be introduced by a second set of switching valves and introduction nozzles. However, it is particularly favorable if a portion of the carrier gas of the supersonic gas jet is itself used as the collision gas. This requires that a portion of the supersonic gas jet is skimmed off the core of the supersonic gas jet by a skimmer and introduced into the deceleration region so quickly that it can have a decelerating effect when the analyte ions arrive. The skimming decelerates the molecules of the supersonic gas jet and increases the temperature of the gas. Only the clusters in the remaining core of the supersonic gas jet are used for the ionization. The skimmer produces a fine supersonic gas jet of only 0.2 to 1 millimeter diameter in the core, in some embodiments, however, up to 3 millimeters, with which a small sample site on the sample support can be scanned particularly well. In some embodiments, the skimmer can be made adjustable as to control the amount of gas skimmed-off. In further embodiments, additional devices may be used to control the propagation of the skimmed-off gas to the deceleration region. The sample support can preferably be moved in two directions with the aid of a movement device; this allows many different sample sites with different samples to be analyzed.

Helium or hydrogen can be used as the carrier gas. The latter has the advantage of a higher supersonic speed in addition to its cost advantages. However, it has been found that if the velocity of the clusters is too high, molecules of the sample support are also ablated, even if a metal sample support is used. The speed of the clusters can, however, be reduced and adjusted to give an optimum yield of analyte ions by adding larger quantities of cluster substance or by adding a neutral gas of higher molecular weight such as nitrogen or argon. The disadvantage of hydrogen as the carrier gas, namely that it produces smaller clusters than helium, can be compensated by increasing the proportion of cluster substance molecules within the gas.

To date only substances with polar molecules have been used as cluster substance gas. Sulfur dioxide has been used most frequently; water has the slight disadvantage that it cannot be added to the carrier gas in arbitrarily high concentrations at normal temperatures, especially since the carrier gas is at an elevated pressure of 10 to 20 bar. However, preliminary experiments undertaken by the inventors have shown that non-polar substances, such as carbon dioxide, also form ionizing clusters. Particularly low-cost operation of an ion source can be achieved with hydrogen and carbon dioxide ($CO_2$). The $CO_2$ forms $H_2CO_3$ with water molecules on the sample support plate, dissociating easily and thus providing sufficient amounts of protons. It is also possible to add a small quantity of water vapor to the carrier gas in addition to the $CO_2$ in order to already embed $H_2CO_3$ molecules into the clusters and allow them to partially dissociate. According to the inventor's already published investigations, cluster substances which themselves strongly dissociate, like $HNO_3$, result in particularly high yields of analyte ions. In the invention, therefore, also light acids are proposed, in particular light organic acids, such as formic acid or acetic acid, and other substances which are effective as proton donors, such as hydrogen peroxide ($H_2O_2$), as cluster substances.

In other words, the invention relates to a method for generating analyte ions by subjecting analyte substances on a sample support to bombardment with uncharged clusters in an ion source of a mass spectrometer, wherein kinetic energies of the analyte ions, which have a broad distribution, are homogenized by decelerating the analyte ions by a collision gas in a deceleration region, and wherein the collision gas in the deceleration region is pulsed temporarily to a pressure above a pressure at which the sample support is held at least for a desired duration of the bombardment, and the timing of the pulsing is one of coordinated and synchronized with a pulsed cluster bombardment.

In various embodiments, the sample support is held at a pressure of less than 10 pascal, and the collision gas is pulsed temporarily to a pressure above 10 pascal.

In various embodiments, the deceleration region is located in the interior of an RF ion guide, such as an RF ion funnel.

In various embodiments, the uncharged clusters are generated and accelerated in a pulsed supersonic gas jet.

In various embodiments, a fraction of the gas from the pulsed supersonic gas jet is fed into the deceleration region and used as the collision gas.

In various embodiments, a skimmer lets through a core of the pulsed supersonic gas jet for the ionization of the analyte molecules on the sample support, while the gas skimmed off from a periphery is at least partially fed into the deceleration region.

In various embodiments, the clusters are essentially composed of molecules of at least one of the polar compounds sulfur dioxide, water, and nitric acid.

In further embodiments, the clusters are essentially composed of molecules of at least one of the non-polar carbonic compounds carbon dioxide ($CO_2$), methane ($CH_4$), ethane ($C_2H_6$), ethene ($C_2H_4$), and ethyne ($C_2H_2$).

In still further embodiments, the clusters are essentially composed of molecules of at least one of the light acids hydrochloric acid, sulfuric acid, formic acid, and acetic acid.

In various embodiments, hydrogen is used as the carrier gas for the pulsed supersonic gas jet, and the velocity of the clusters is optimized by means of a starting temperature, a species and a concentration of the cluster substance molecules, an optional admixture of neutral gases such as nitrogen or argon, or any combination thereof, so that the analyte molecules are ionized with a high degree of ionization.

In another aspect, the invention relates to an ion source of a mass spectrometer, comprising means of generating a pulsed supersonic jet with clusters, a sample support with analyte molecules on its surface, the sample support being arranged for receiving the supersonic jet with clusters, an RF ion guide for the capture and transmission of analyte ions, the RF ion guide being arranged in an opposing relation to the sample support, and a device for pulsing collision gas into the RF ion guide, whose mode of operation includes pulsing the collision gas in the RF ion guide temporarily to a pressure above a pressure at which the sample support is held at least for a desired duration of the bombardment, and one of coordinating and synchronizing the timing of the pulsing with a pulsed cluster bombardment.

In various embodiments, the RF ion guide has the form and function of an RF ion funnel.

In various embodiments, the ion source additionally comprises a skimmer to skim off gas from a periphery of the supersonic gas jet.

In various embodiments, the ion source additionally comprises a device for feeding a portion of the gas skimmed off by the skimmer to the interior of the RF ion guide.

In various embodiments, the device for generating a supersonic jet with clusters is a switching valve nozzle.

In a further aspect, the invention relates to an ion source of a mass spectrometer, comprising means of generating a pulsed supersonic jet with clusters, a sample support with analyte molecules on its surface, the sample support being arranged for receiving the supersonic jet with clusters, an RF ion guide for the capture and transmission of analyte ions, the RF ion guide being arranged in an opposing relation to the sample support, and a device for pulsing collision gas into the RF ion guide, the device comprising a skimmer to skim off gas from a periphery of the supersonic gas jet, wherein at least a portion of the skimmed-off gas is used as collision gas.

In still another aspect, the invention relates a mass spectrometer which comprises an ion source having means of generating a pulsed supersonic jet with clusters, a sample support with analyte molecules on its surface, the sample support being arranged for receiving the supersonic jet with clusters, an RF ion guide for the capture and transmission of analyte ions, the RF ion guide being arranged in an opposing relation to the sample support, and a device for pulsing collision gas into the RF ion guide, whose mode of operation includes pulsing the collision gas in the RF ion guide temporarily to a pressure above a pressure at which the sample support is held at least for a desired duration of the bombardment, and one of coordinating and synchronizing the timing of the pulsing with a pulsed cluster bombardment.

In various embodiments, the mass spectrometer additionally includes an RF ion trap as its mass analyzer.

BRIEF DESCRIPTION OF THE DRAWINGS

FIG. 2 shows a first schematic design version with satisfying functionality. An arrangement with an additional switching valve nozzle (10) generates a second pulsed supersonic gas jet (11) from a suitable collision gas. The molecules (13) of this second gas jet are scattered predominantly into the RF ion funnel (7) at the diverting and thermalizing ring deflector (12) in order to decelerate the analyte ions (6) here. (Nozzle (10) and ring deflector (12) can easily be replaced by other means of introducing the collision gas into the RF ion funnel.) The supersonic gas jet (11) is to be pulsed in synchronization with the supersonic gas jet (4) in such a way that the RF ion funnel (7) is filled with collision gas (13) at a sufficiently high pressure at the time of the arrival of the analyte ions (6). This arrangement produces a high yield of analyte ions. However, a second switching valve nozzle with appropriate gas supplies and gas feed pipes is required in this design.

In FIG. 3 some of the molecules of the supersonic gas jet (4) itself are used as the collision gas. These molecules are skimmed off the core of the supersonic gas jet (4) by the skimmer (14) and some of them are scattered into the RF ion funnel (7). The path from the skimmer (14) into the RF ion funnel (7) must be short enough so that the collision gas molecules arrive in the ion funnel (7) before the analyte ions (6). The path of the core jet from the supersonic gas jet (4) is protected by the tube (16) against a fast penetration of collision gas, and the spreading beam of analyte ions (6) is also protected by a housing (17). The housing (17), or parts of it, is maintained at a potential which draws the analyte ions from the sample support plate and accelerates them slightly in order to guide them better to the RF ion funnel (7).

In FIG. 4 a diverting and thermalizing plate (18) has been added, which provides better scattering of the skimmed portion of the supersonic gas jet into the RF ion funnel (7).

Finally, FIG. 5 shows how the analyte ions (6) within the housing (17) are guided better in the direction of the RF ion funnel (7) by an arrangement of focusing rings (19). Positive and negative voltages are applied to adjacent focusing rings (19), thus producing a focusing effect for quickly moving ions, as known by practitioners in the field.

In FIG. 6, the ion source (20), which corresponds to the one in FIG. 5, is attached to a conventional ion trap mass spectrometer. The ions from the ion source (20) are fed by RF ion guides (21) and (24) through the differential pumping stages with the pumps (9), (27) and (28) into the three-dimensional radio-frequency ion trap (25) and can be analyzed in the known way by mass-sequential ejection to the ion detector (26). It is also possible to introduce reactant ions from the ion source (22) into the RF ion guide (24) at the location (23), and from there into the ion trap (25), in order to dissociate analyte ions by electron transfer (ETD), for example. The RF ion trap is best operated at a gas pressure of around 0.1 pascal; the gas, preferably helium, is fed in through the supply line (27).

FIG. 7 depicts a particularly simple embodiment of the RF ion trap mass spectrometer with only one high vacuum pump (9). The analyte ions here are fed directly from the RF ion funnel into the RF ion trap (25). The gas for the optimum operation of the RF ion trap can be supplied via supply line (27), but in the simplest case can originate solely from the collision gas out of the RF ion funnel.

DETAILED DESCRIPTION

Figure 1:
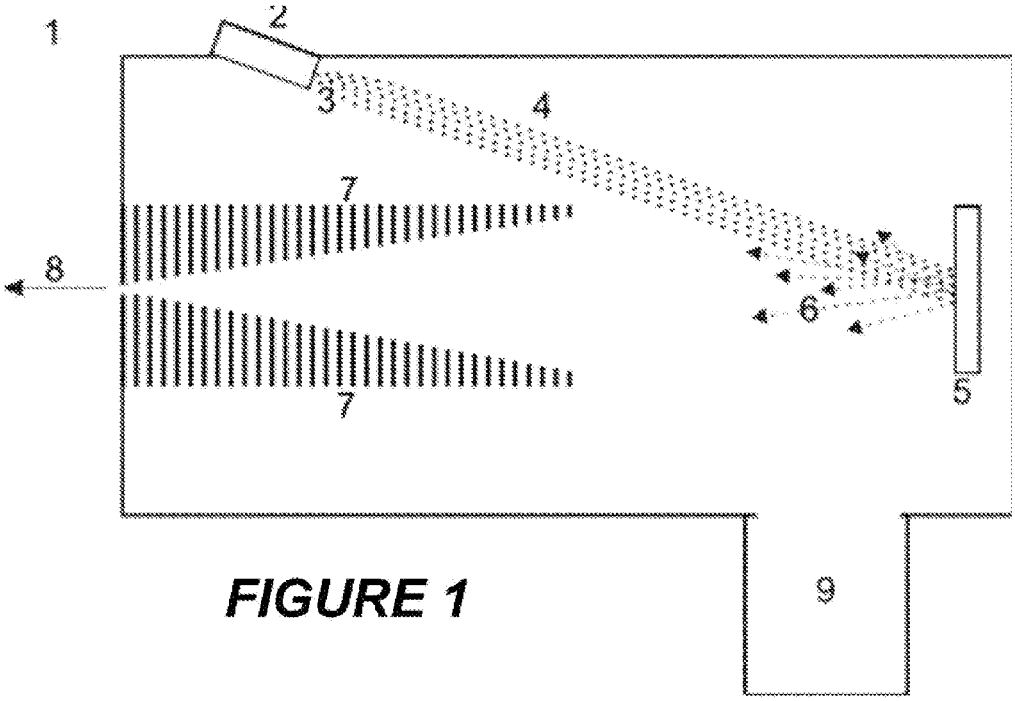
FIG. 1 outlines schematically the basic version of an ion source, with a switching valve nozzle (2), which generates a pulsed supersonic gas jet (4) in a vacuum housing (1) with a high vacuum pump (9). The gas jet, together with its clusters, impacts on the sample support plate (5) and produces analyte ions there from the analyte molecules applied on sample sites; these analyte ions fly off the sample support plate (5), mainly accelerated by the expanding gas of the cluster and, in addition, by the potential difference between an RF ion funnel (7) and the sample support plate (5). The RF ion funnel (7) is designed to guide the analyte ions through the small exit aperture in the direction (8) to the mass analyzer. According to the investigations undertaken by the inventors, however, this arrangement produces only a very low yield because the ion funnel without collision gas is hardly able to capture the ions, to decelerate the ions to a homogenized energy and to guide them onwards.

While the invention has been shown and described with reference to a number of embodiments thereof, it will be recognized by those skilled in the art that various changes in form and detail may be made herein without departing from the spirit and scope of the invention as defined by the appended claims.

As already mentioned above, the analyte ions, which are produced with a large spread in their kinetic energies by the pulsed cluster bombardment of analyte substances on a sample support, are decelerated, according to the invention, in a gas of higher density with a pressure of around 10 to 300 pascal, which homogenizes their kinetic energies. In some embodiments, a pressure of down to 1 pascal may be sufficient. The collision gas remains in the largely open deceleration region for a short time only and may have been fed in precisely at the time the first analyte ions arrive. The collision gas is therefore to be fed into the deceleration region only in short pulses. This pulsing of the collision gas is coordinated and/or synchronized with the pulsed supersonic gas jet, with an optimized time delay where necessary. The collision gas quickly expands from the deceleration region into the surroundings and may be pumped off again before the next supersonic gas pulse, because it would otherwise prevent the cluster ionization by destroying the clusters in the supersonic gas jet.

The pulsed supersonic gas jet is preferably generated by briefly opening the switching valve of a nozzle. The carrier gas should have a pressure of around 10 to 20 bar in front of the switching valve, and a temperature of around 300 to 420 kelvin. The nozzle itself can be a simple aperture, or a nozzle with a complex shape, a Laval nozzle, for example. The latter produces a higher quality supersonic gas jet with good homogeneity of the kinetic energies of the flying particles. The widening of the jet in region (3) is shifted into the nozzle exit region.

It is particularly favorable if an RF ion guide, in particular the interior of an RF ion funnel, is used as the deceleration region. Such RF ion funnels (7) are depicted schematically in FIGS. 1 to 5. As is known to those skilled in the art, an RF ion funnel is comprised of a series of ring diaphragms with continuously decreasing internal diameters, and opposite phases of an RF voltage are applied to adjacent diaphragms. Pseudopotentials are generated along the inner funnel wall, which keep the ions away from the wall. In addition, DC potentials are supplied to the diaphragms. These DC potentials change from diaphragm to diaphragm, and guide the decelerated analyte ions, which have been concentrated by the ion funnel, to the small exit aperture. Through this exit aperture they can enter the next stage of the mass spectrometer with well homogenized kinetic energy. The intermediate spaces between the diaphragms are usually open in order to let gas escape; in the present embodiments, however, the intermediate spaces can be advantageously closed with insulation material in order to make the immediate escape of the collision gas more difficult.

The RF ion funnel has further advantages. The analyte ions are shaken to and fro by the RF field in the vicinity of the electrodes as they pass through the collision gas; this homogenizes the kinetic energies particularly well. In addition, all cluster substance molecules which have remained adsorbed are stripped off the analyte ions. Moreover, all small ions, such as free protons or ionized cluster substance molecules, are removed because their mass is below the reflection limit of the pseudopotential; these ions hit the electrode rings and are discharged or are expelled from the funnel through the gaps between adjacent electrode rings.

FIG. 1 represents schematically the basic ion source for the invention. This ion source contains a device which generates the pulsed supersonic gas jet (4) in the vacuum housing (1), here in the form of a switching valve nozzle (2). The supersonic gas jet (4) widens slightly in region (3) after leaving the nozzle and, in this process of widening, simultaneously cools and accelerates. Cooling and accelerating by slightly widening a parallel beam is a characteristic of supersonic jets, quite in contrast to normal subsonic jets. Most of the clusters are formed in this region (3). The supersonic gas jet (4) loses a part of the gas during its flight; the residual gas, including all the clusters, then impacts on the sample support (5), which is coated with analyte molecules, and thus produces analyte ions (6). These are partly accelerated up to several hundred electronvolts by the expanding gas clouds, drawn into the ion funnel (7) by a potential difference of around 10 to 20 volts between the ion funnel (7) and sample support (5). The ion funnel (7) is designed to guide the analyte ions through the small exit aperture in the direction (8) to the mass analyzer. The gas pulsed into the vacuum housing (1) by the switching valve nozzle (2) is pumped off again by a powerful high vacuum pump (9) so that after around 50 to 100 milliseconds, in some embodiments down to 10 milliseconds, the next supersonic gas pulse can be started. The inventors' experience with this ion source has shown, however, that this basic arrangement shows only a very low yield of ions because the ion funnel is scarcely able to capture the ions and guide them onwards without the effect of a collision gas at higher pressures.

Figure 2:
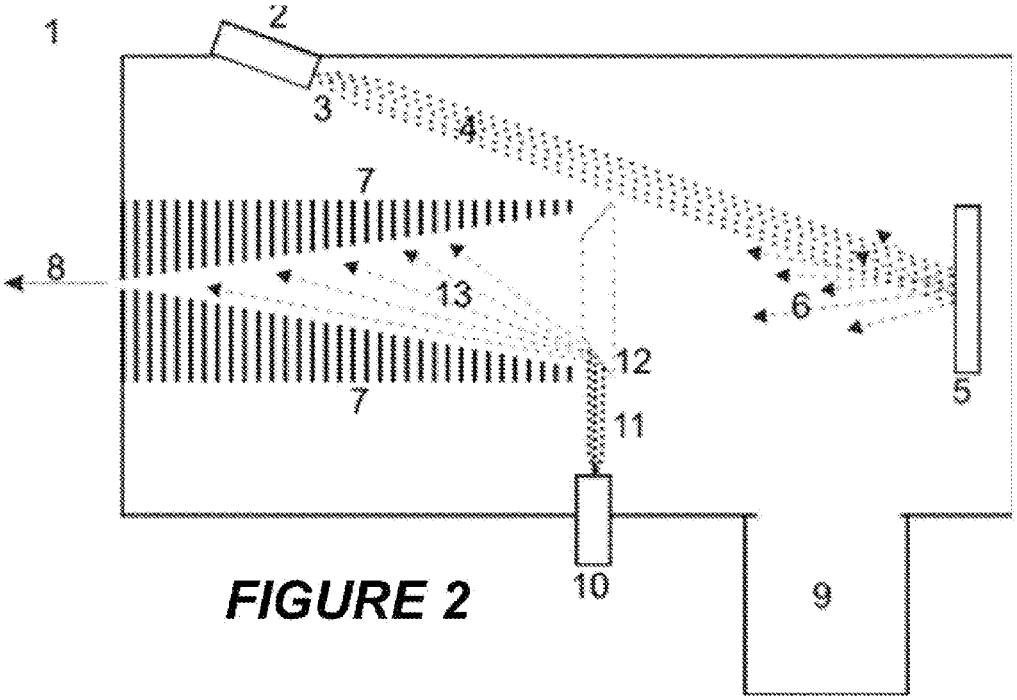
FIGS. 2 to 7 show different embodiments of the arrangements for methods and devices according to the invention.

FIG. 2 illustrates a first embodiment which works well. A second switching valve nozzle (10) feeds a collision gas in pulses into the vacuum chamber (1), where it forms into a second supersonic gas jet (11). This second supersonic gas jet (11) impacts on the tapered ring diaphragm (12), where it is thermalized by the impact and scattered as collision gas (13) into the interior of the ion funnel (7). Instead of nozzle (10) and deflection ring (12), other arrangements can also be used to fill the ion funnel with thermalized collision gas. The pulses of the first supersonic gas jet (4) with its clusters and the pulses of the collision gas (11) are synchronized in such a way that the ion funnel is full with collision gas at optimum pressure when the analyte ions (6) arrive in the ion funnel (7). The tapered ring diaphragm (12) has a potential with respect to the sample support plate (5), and this potential attracts the ions (6) and gently accelerates them into the ion funnel. Two switching valve nozzles are required with two gas feeds.

Figure 3:
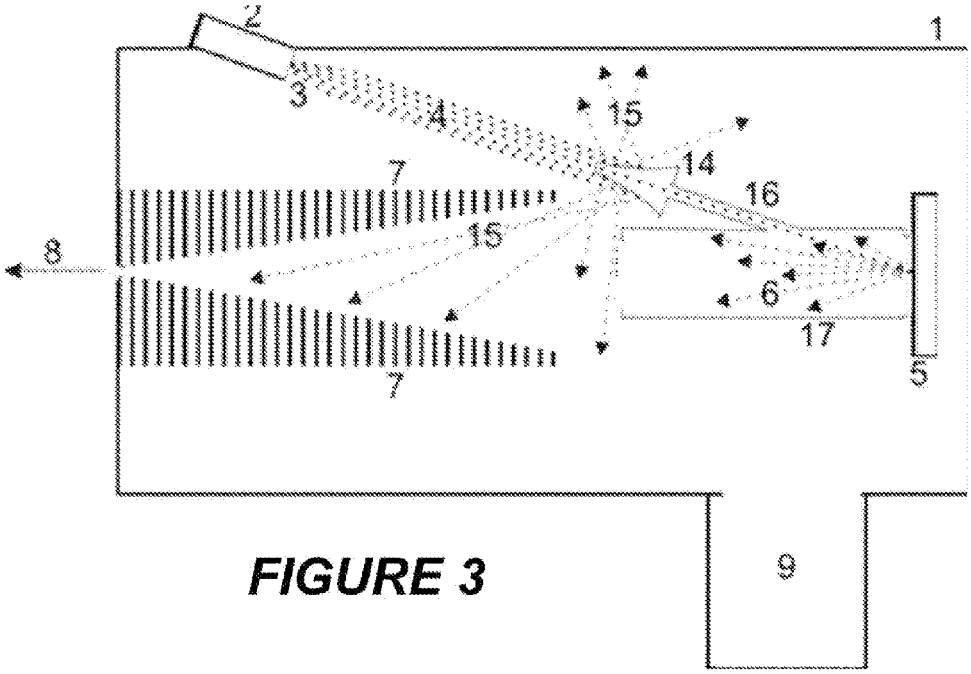

FIG. 3 depicts an embodiment which simplifies the arrangement and lowers the cost. Here a fraction of the carrier gas of the supersonic gas jet (4) itself is used as the collision gas. A fraction of the supersonic gas jet (4) is skimmed off the core of the supersonic gas jet by a skimmer (14). Part of the skimmed-off and thermalized carrier gas (15) is fed into the ion funnel (7) by scattering so that it can have a decelerating effect when the analyte ions arrive. The skimming decelerates the molecules of the supersonic gas jet (4) and increases the temperature. Only the clusters in the remaining core of the supersonic gas jet are used for the ionization. The skimmer with an aperture of around 0.2 to 1 millimeter causes a thinned out, fine supersonic gas jet with clusters to form in the interior, which allows a small sample site on the sample support plate (5) to be scanned particularly well. The clusters moving at a velocity of around 1,000 meters per second take around 80 to 100 microseconds to travel from the aperture of the skimmer (14) to the sample support plate (5), and the analyte ions (6) take another 10 to 50 microseconds or so to reach the ion funnel (7). In this time, the thermalized gas at a velocity of 300 meters per second has just flown into the ion funnel (7).

Figure 8:
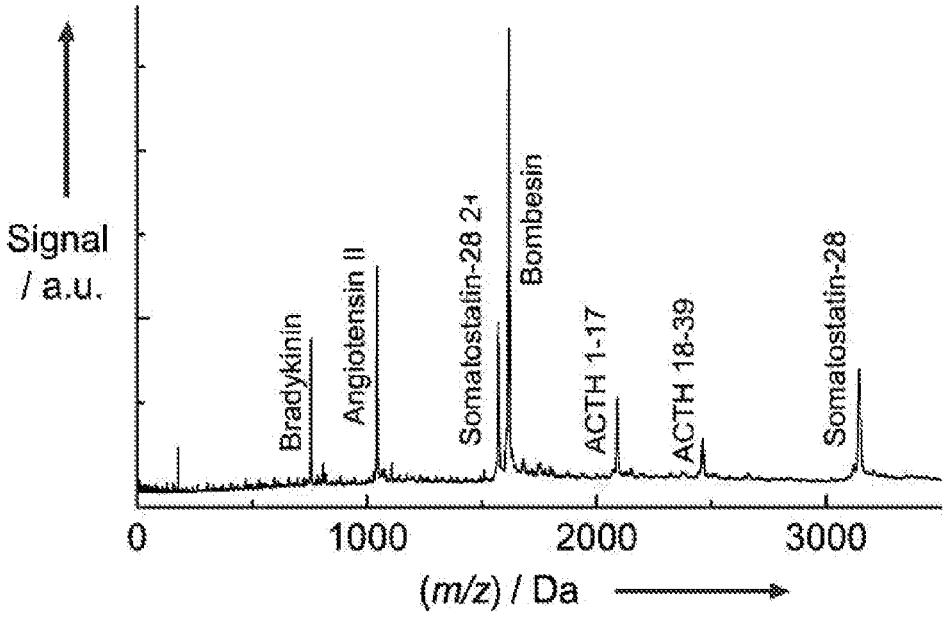
FIG. 8 shows the mass spectrum of a mixture of proteins, which was acquired in an instrument according to FIG. 3.

This arrangement already has a satisfactorily high degree of efficiency. It was used to acquire the mass spectra shown in FIGS. 8 and 9.

In order that the skimmed-off carrier gas does not interfere with the core of the supersonic gas jet, which flies on, this core jet is protected by a tube (16), which prevents a fast penetration of the scattered gas. The analyte ions (6) are also protected by a tube (17). Toward the sample support plate (5), the tube (17) has a grid or an ion-optical arrangement made out of ring diaphragms, whose potentials can be used to pull slow analyte ions (6) into the housing and accelerate them slightly. In this arrangement, however, a large proportion of the skimmed-off carrier gas (15) is lost to the surroundings by scattering.

Figure 4:
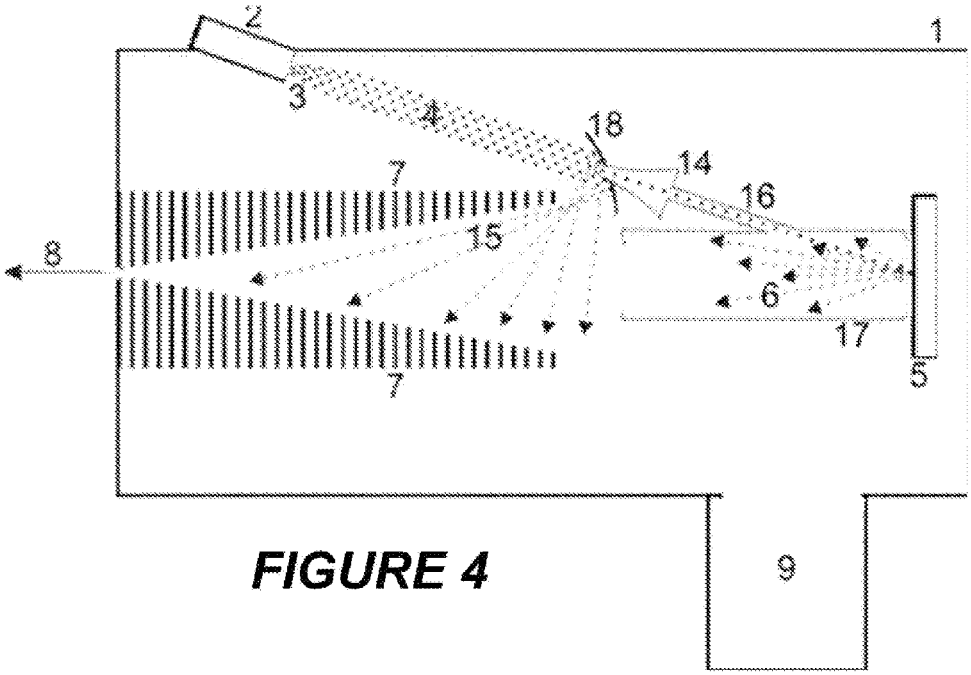
Figure 5:
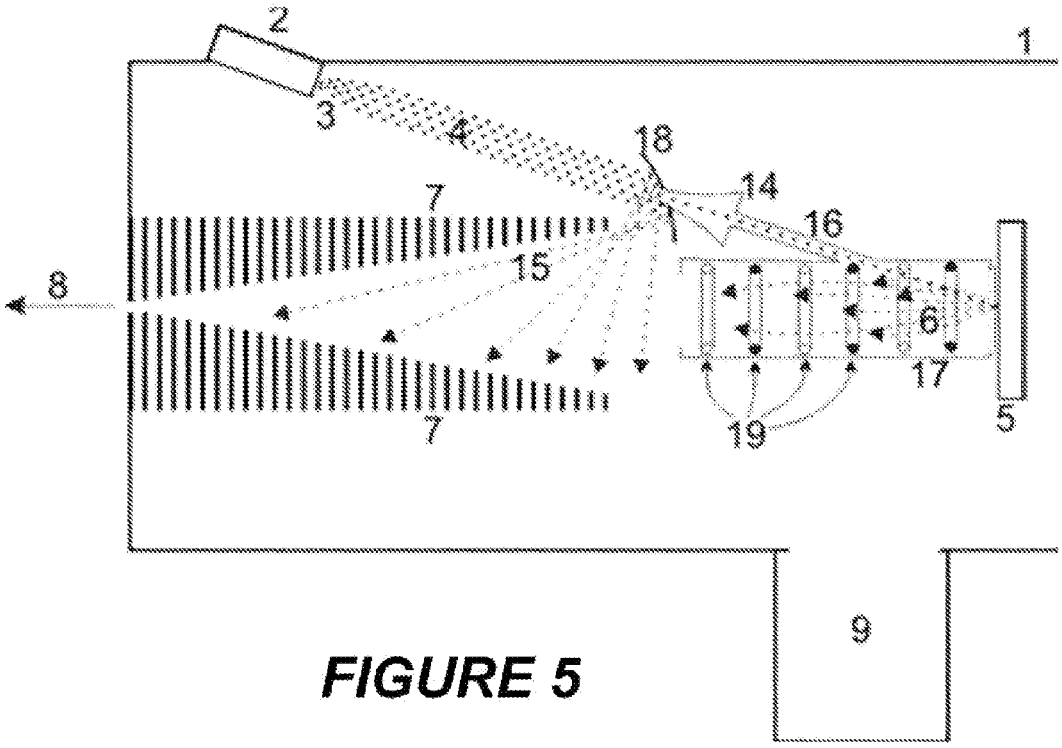

FIG. 4 shows how an impact plate (18) can be additionally introduced into the arrangement to provide better deflection of the skimmed-off gas into the ion funnel. The shape of the impact plate can be optimized for very low-pressure gas flows with the aid of simulation programs. In FIG. 5 a series of ring electrodes (19) has additionally been introduced into the tube (17). Positive and negative DC potentials are applied to adjacent ring electrodes. As those skilled in the art are aware, these potentials have a focusing effect on moving ions with very different kinetic energies, and thus guide the ions into the ion funnel with a high yield.

Helium or hydrogen can be used as carrier gases, and both achieve sufficiently high supersonic speeds for the cluster ionization of analyte molecules. Apart from its cost advantages, hydrogen also has the advantage of the highest supersonic speed, which allows a higher concentration of the cluster substance molecules. But it has been found that too high a cluster velocity leads to molecules of the sample support also being ablated, even if metal sample supports are used. The speed can, however, be reduced and adjusted to an optimum yield of analyte ions by adding larger quantities of cluster substance molecules, by the initial pressure and temperature of the gas, or by adding a heavier neutral gas such as nitrogen or argon.

The speed of the supersonic gas jet depends on the type and composition of the carrier gas, and in particular also on the starting temperature, i.e. the temperature of the carrier gas in front of the switching valve nozzle. In the supersonic gas jet, the thermal energy of the carrier gas is converted into the kinetic energy of the molecules steadily flying side by side in the supersonic gas jet. For a reproducible ionization method, the carrier gas must therefore be maintained at a temperature of around 300 to 420 kelvin in a heating or cooling device. The speed of the clusters required for an optimally high yield of analyte ions can thus be adjusted via the starting temperature and via the composition of the carrier gas.

The cluster substances used to date have been almost exclusively substances with polar molecules. Sulfur dioxide and water have been used most frequently. Water has the slight disadvantage that it cannot be added to the carrier gas in arbitrarily high concentrations at normal temperatures, especially since the carrier gas is at an elevated pressure of 10 to 20 bar and the partial pressure of water depends only on the vapor pressure at the particular temperature, but not on the ambient pressure.

Experiments performed by the inventors, however, have shown that non-polar substances such as carbon dioxide also form clusters which are suitable for ionizing the analyte ions. Particularly low-cost operation of an ion source can be achieved with hydrogen as the carrier gas and carbon dioxide ($CO_2$) as the cluster substance. The $CO_2$ forms $H_2CO_3$ with water molecules on the sample support plate; this carbonic acid dissociates easily and therefore provides protons for proton transfers. It is also possible to add a small quantity of water vapor to the carrier gas in addition to the $CO_2$ in order to already embed $H_2CO_3$ molecules into the clusters. The $H_2CO_3$ molecules and their dissociation products would then be available for a proton transfer or proton association to as yet uncharged analyte molecules.

It is considered possible that other non-polar substances such as methane, ethane, ethene, ethyne or higher saturated or unsaturated hydrocarbons are also suitable for the formation of ionizing clusters. Since many analyte molecules on the sample support plates are already ionized, it is possible that no further ionization by proton transfer is necessary. However, the inventors have already ascertained that cluster substances which themselves dissociate, like $HNO_3$, result in particularly high yields of analyte ions. The invention therefore also proposes light acids as cluster substances, in particular light organic acids, such as formic acid or acetic acid, and also hydrochloric acid (HCl) or sulfuric acid ($H_2SO_4$), and other substances which are effective as proton donors, such as hydrogen peroxide ($H_2O_2$).

Figure 9:
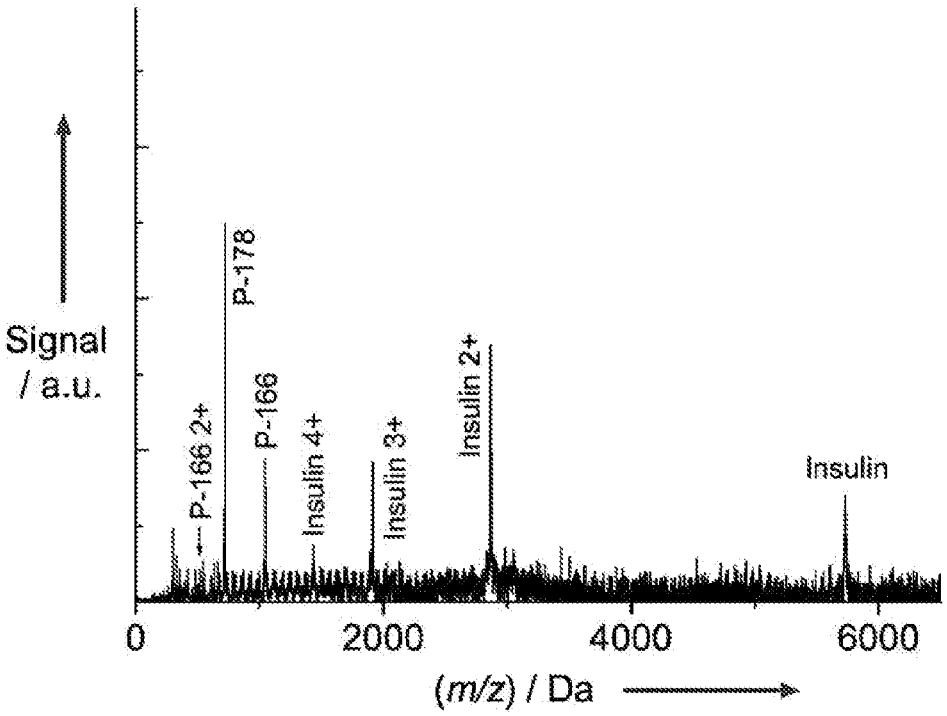
FIG. 9 depicts the mass spectrum of insulin, which here was applied in a solution acidified by hydrochloric acid at pH=2 onto a sample support made from surface-oxidized silicon, and primarily shows multiply charged ions.

The pH value of the solution in which the analyte molecules are applied to the sample support can even be used to control how many multiply charged analyte ions are produced. FIG. 9 depicts a mass spectrum of insulin with doubly, triply and quadruply charged ions, which was applied to the sample support in a solution acidified by hydrochloric acid at pH=2. The material of the sample support is possibly important here; in this case it was surface-oxidized silicon. The sample support can be composed of metal, usually stainless steel, and also of semiconductors such as silicon or even of electrically conductive plastic.

Figure 6:
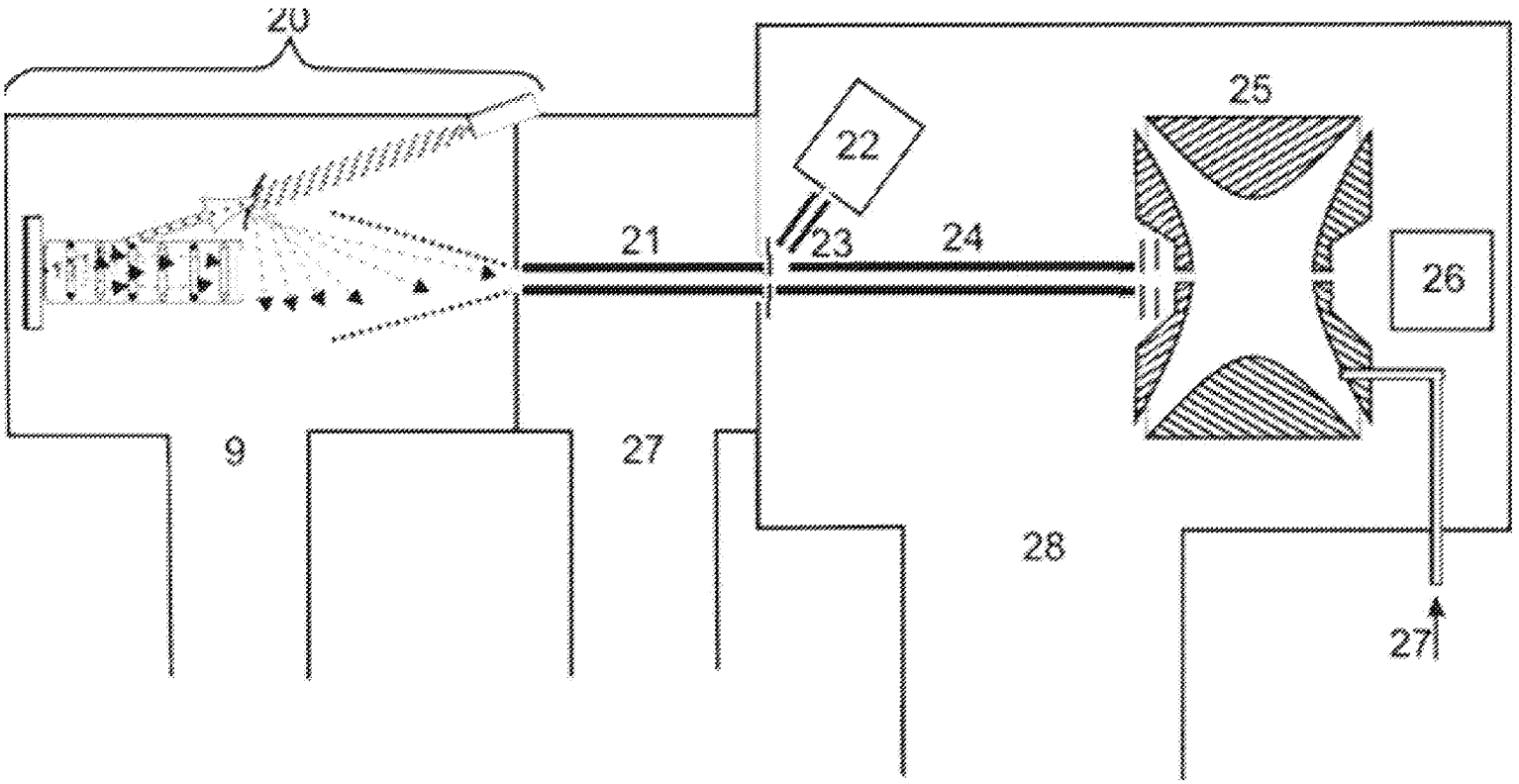
Figure 7:
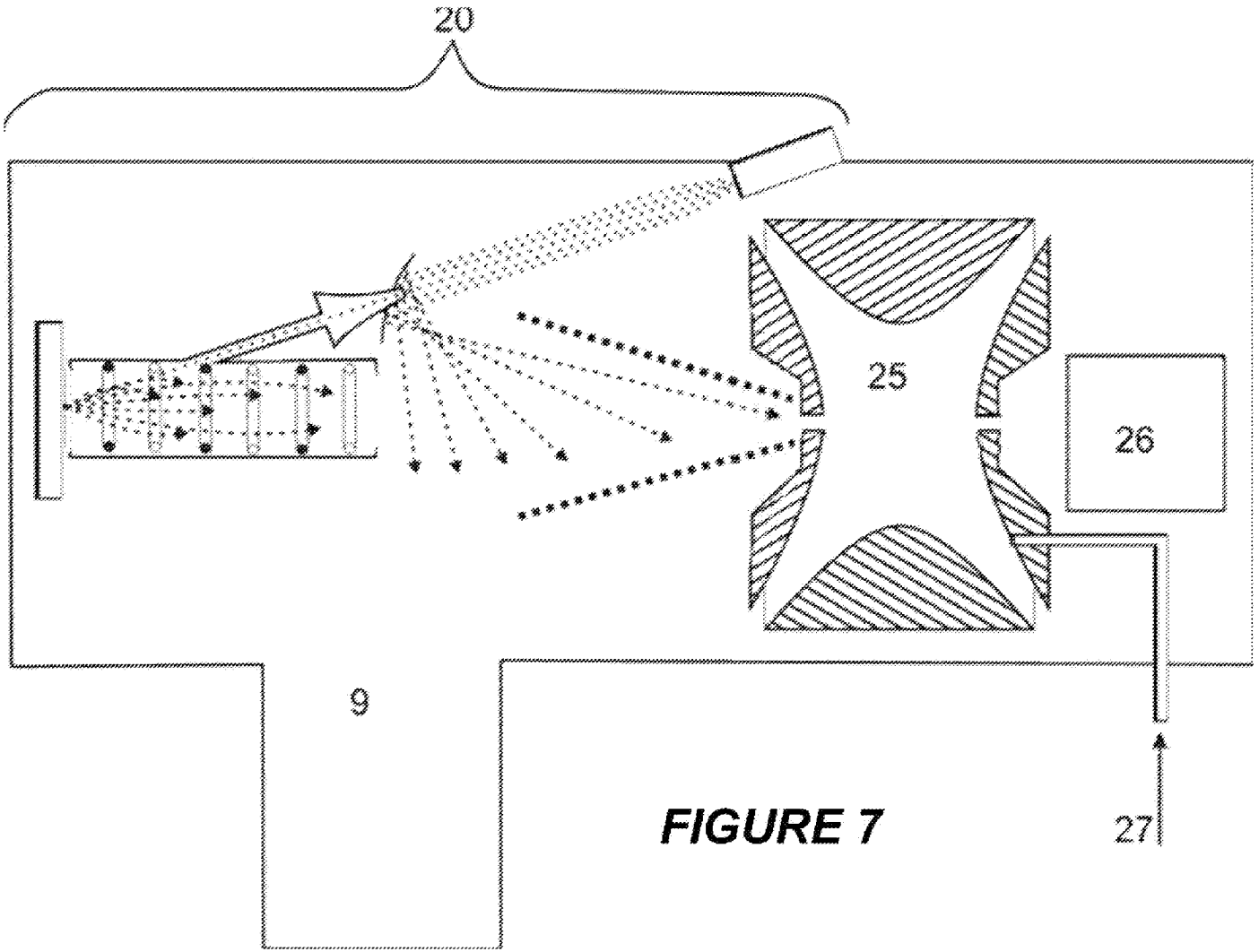

The ion source according to the invention can be attached to any mass spectrometer which can operate with a pulsed ion beam of 50 to 200 microsecond duration, in some embodiments up to 1,000 microseconds. Many mass spectrometers, for example time-of-flight mass spectrometers with orthogonal ion injection, can temporarily store the ions in appropriately formed RF ion guides. RF ion trap mass spectrometers appear to be particularly suitable, because they can be well filled with analyte ions from a single supersonic gas pulse, and their repetition frequency for acquiring spectra can be technically adjusted to the pulse rate of the supersonic gas. Embodiments of this mass spectrometer are depicted schematically in FIGS. 6 and 7.

The invention has been described with reference to a number of embodiments thereof. It will be understood, however, that various aspects or details of the invention may be changed without departing from the scope of the invention. Furthermore, the foregoing description is for the purpose of illustration only, and not for the purpose of limiting the invention, which is defined solely by the appended claims.

The invention claimed is:

1. A method for generating analyte ions comprising:

subjecting analyte substances on a sample support of an ion source of a mass spectrometer to a pulsed bombardment with uncharged molecular clusters to produce analyte ions; and homogenizing kinetic energies of the analyte ions by decelerating the analyte ions with a collision gas in a deceleration region that is pulsed temporarily to a pressure above a pressure at which the sample support is held at least for a desired duration of the bombardment, the timing of the collision gas pulsing being coordinated with said pulsed cluster bombardment.

2. The method according to claim 1, wherein the sample support is held at a pressure of less than 10 pascal, and the collision gas is pulsed temporarily to a pressure above 10 pascal.

3. The method according to claim 1, wherein the deceleration region is located in the interior of an RF ion guide.

4. The method according to claim 3, wherein the deceleration region is located in the interior of an RF ion funnel.

5. The method according to claim 1, wherein the uncharged clusters are generated and accelerated in a pulsed supersonic gas jet.

6. The method according to claim 5 further comprising redirecting a fraction of the gas from the pulsed supersonic gas jet to the deceleration region to be used as the collision gas.

7. The method according to claim 6, wherein redirecting a fraction of the gas from the pulsed supersonic gas jet comprises redirecting said fraction with a skimmer that lets through a core of the pulsed super-sonic gas jet for the ionization of the analyte molecules on the sample support.

8. The method according to claim 1, wherein the clusters comprise molecules of at least one of the polar compounds sulfur dioxide, water, and nitric acid.

9. The method according to claim 1, wherein the clusters comprise molecules of at least one of the non-polar carbonic compounds carbon dioxide ($CO_2$), methane ($CH_4$), ethane ($C_2H_6$), ethene ($C_2H_4$), and ethyne ($C_2H_2$).

10. The method according to claim 1, wherein the clusters comprise molecules of at least one of the light acids hydrochloric acid, sulfuric acid, formic acid, and acetic acid.

11. The method according to claim 1, wherein the pulsed bombardment of uncharged clusters comprises a bombardment using a pulsed supersonic hydrogen gas jet, and a velocity of the clusters is optimized through control of at least one of a starting temperature, a species and concentration of the cluster substance molecules, and an optional admixture of neutral gases such as nitrogen or argon, such that the analyte molecules are ionized with a high degree of ionization.

12. An ion source of a mass spectrometer, comprising:

a cluster source generating a pulsed supersonic gas jet with uncharged molecular clusters;

a sample support with analyte molecules on its surface, the sample support being arranged for receiving a pulsed bombardment of clusters from the supersonic gas jet;

an RF ion guide for the capture and transmission of analyte ions, the RF ion guide being arranged in an opposing relation to the sample support; and a device for conveying pulsed collision gas into the RF ion guide so as to temporarily and repeatedly raise a pressure of the collision gas in the RF ion guide to a pressure above a pressure at which the sample support is held at least for a desired duration of the bombardment, a timing of the collision gas pulsing being coordinated with said pulsed cluster bombardment.

13. The ion source according to claim 12, wherein the RF ion guide has the form and function of an RF ion funnel.

14. The ion source according to claim 12, wherein the device for conveying pulsed collision gas into the RF ion guide comprises a skimmer to skim off gas from a periphery of the supersonic gas jet.

15. The ion source according to claim 14, further comprising a device for feeding a portion of the gas skimmed off by the skimmer to an interior of the RF ion guide.

16. The ion source according to claim 12, wherein the cluster source comprises a switching valve nozzle.

* * * * *